US011199330B2

(12) United States Patent
Hendrickson et al.

(10) Patent No.: US 11,199,330 B2
(45) Date of Patent: Dec. 14, 2021

(54) UNDERMOUNT COOKTOP ASSEMBLY

(71) Applicant: WHIRLPOOL CORPORATION, Benton Harbor, MI (US)

(72) Inventors: Michael S. Hendrickson, Stevensville, MI (US); Sean M. Howley, Saint Joseph, MI (US); Martin Lach, Buchanan, MI (US); Timothy A. Mayberry, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 207 days.

(21) Appl. No.: 16/507,800

(22) Filed: Jul. 10, 2019

(65) Prior Publication Data

US 2020/0088414 A1 Mar. 19, 2020

Related U.S. Application Data

(60) Provisional application No. 62/732,246, filed on Sep. 17, 2018.

(51) Int. Cl.

| | |
|---|---|
| ***H05B 3/68*** | (2006.01) |
| ***F24C 15/10*** | (2006.01) |
| ***A47B 77/08*** | (2006.01) |

(52) U.S. Cl.

CPC ..... *F24C 15/108* (2013.01); *A47B 77/08* (2013.01)

(58) Field of Classification Search

CPC .... A47B 77/08; F24C 3/08–085; F24C 15/10; F24C 15/102; F24C 15/108; H05B 3/68; H05B 3/74–748

USPC ..... 219/443.1–468.2

See application file for complete search history.

(56) References Cited

U.S. PATENT DOCUMENTS

| | | | | |
|---|---|---|---|---|
| 5,429,114 | A * | 7/1995 | Taplan | F24C 15/108 126/211 |
| 5,743,501 | A | 4/1998 | Rapp | |
| 6,111,229 | A | 8/2000 | Schultheis | |
| 2005/0006379 | A1 | 1/2005 | Sullivan | |
| 2016/0057815 | A1 | 2/2016 | Shaw | |
| 2016/0169532 | A1 * | 6/2016 | Iurk | H05B 6/1209 219/452.12 |

FOREIGN PATENT DOCUMENTS

| | | | |
|---|---|---|---|
| DE | 7418347 | U | 12/1975 |
| DE | 3446621 | A1 | 6/1986 |

(Continued)

*Primary Examiner* — Sang Y Paik

(74) *Attorney, Agent, or Firm* — Price Heneveld LLP

(57) ABSTRACT

A cooktop assembly includes a countertop defining a cutout portion, and a countertop contact area is disposed proximate a perimeter of the cutout portion on a lower surface of the countertop. A cooktop defines a work portion, and a cooktop contact area is disposed proximate a perimeter of the work portion on an upper surface of the cooktop. An attachment assembly includes a first attachment member positionable on a first side of the cutout portion of the countertop. A second attachment member is positionable on a second side of the cutout portion of the countertop. The first and second sides are opposing sides, and the first and second attachment members are securable to the countertop and the cooktop to engage the countertop contact area with the cooktop contact area thereby securing the cooktop to the countertop.

20 Claims, 6 Drawing Sheets

(56) References Cited

FOREIGN PATENT DOCUMENTS

| | | | |
|---|---|---|---|
| DE | 3150450 | C2 | 10/1989 |
| DE | 4103664 | C2 | 4/1994 |
| DE | 19912452 | B4 | 10/2007 |
| EP | 2144012 | B1 | 9/2012 |
| EP | 2816291 | A1 | 12/2014 |
| EP | 2848867 | B1 | 9/2017 |
| EP | 3398480 | A1 | 11/2018 |
| ES | 2628413 | A1 | 8/2017 |

* cited by examiner

UNDERMOUNT COOKTOP ASSEMBLY

CROSS-REFERENCE TO RELATED APPLICATIONS

This application claims priority to and the benefit under 35 U.S.C. § 119(e) of U.S. Provisional Patent Application No. 62/732,246, filed on Sep. 17, 2018, entitled UNDERMOUNT COOKTOP ASSEMBLY, the entire disclosure of which is hereby incorporated herein by reference.

FIELD OF THE INVENTION

The present disclosure generally relates to a cooktop, and more particularly to a cooktop that may be secured beneath a cutout portion of a countertop.

BACKGROUND

The present device generally relates to a cooktop, and more specifically, to an assembly for securing a cooktop to a countertop.

SUMMARY

In at least one aspect of the disclosure, a cooktop assembly includes a countertop defining a cutout portion, and a countertop contact area is disposed proximate a perimeter of the cutout portion on a lower surface of the countertop. A cooktop defines a work portion, and a cooktop contact area is disposed proximate a perimeter of the work portion on an upper surface of the cooktop. An attachment assembly includes a first attachment member positionable on a first side of the cutout portion of the countertop. A second attachment member is positionable on a second side of the cutout portion of the countertop. The first and second sides are opposing sides, and the first and second attachment members are securable to the countertop and the cooktop to engage the countertop contact area with the cooktop contact area thereby securing the cooktop to the countertop.

In at least another aspect of the disclosure, a cooktop assembly includes a support structure defining first and second sides with a cutout portion disposed between the first and second sides, a first mounting surface disposed below the first side of the support structure, and a second mounting surface disposed below the second side of the support structure. A cooktop defines a work area. A first mounting portion is disposed on a first side of the work area. A second mounting portion is disposed on a second side of the work area. An attachment assembly is arrangeable to secure the first and second mounting surfaces of the support structure to the respective first and second mounting portions of the cooktop.

In at least another aspect of the disclosure, a mechanism for securing an undermount cooktop is disposed below a cutout portion in a countertop. The mechanism includes a bracket having a first flange defining a first mounting area and engageable with a lower surface of the countertop and a second flange defining a second mounting area and engageable with a lower surface of the undermount cooktop. The bracket defines a first recess with the lower surface of the countertop. A first edge of the undermount cooktop is positionable in the recess. A second opposing edge of the undermount cooktop includes an upturned flange. The upturned flange is securable to a wall of the cutout portion in the countertop to secure the undermount cooktop to the countertop.

In at least another aspect of the disclosure, an undermount cooktop assembly includes a cooktop including a work portion and an underside opposite the work portion. The undermount cooktop assembly also includes first and second brackets respectively defining a first engagement member and a second engagement member operably supporting the cooktop along the underside thereof and disposed on opposing sides of the work portion of the cooktop. Each of the first and second brackets further defines respective extension members extending from the engagement members and to respective positions spaced away therefrom in a direction towards the work portion.

In at least another aspect of the disclosure, an attachment assembly for a cooktop includes a cooktop and first and second brackets disposed proximate the cooktop. The first and second brackets are coupled to the cooktop. Each of the first and second brackets includes a first mounting area and a second mounting area. The second mounting area of each of the first and second brackets is positionable to support a lower surface of the cooktop. The first mounting area of each of the first and second brackets is engageable with a countertop.

These and other features, advantages, and objects of the present device will be further understood and appreciated by those skilled in the art upon studying the following specification, claims, and appended drawings.

DETAILED DESCRIPTION OF EMBODIMENTS

Figure 1:
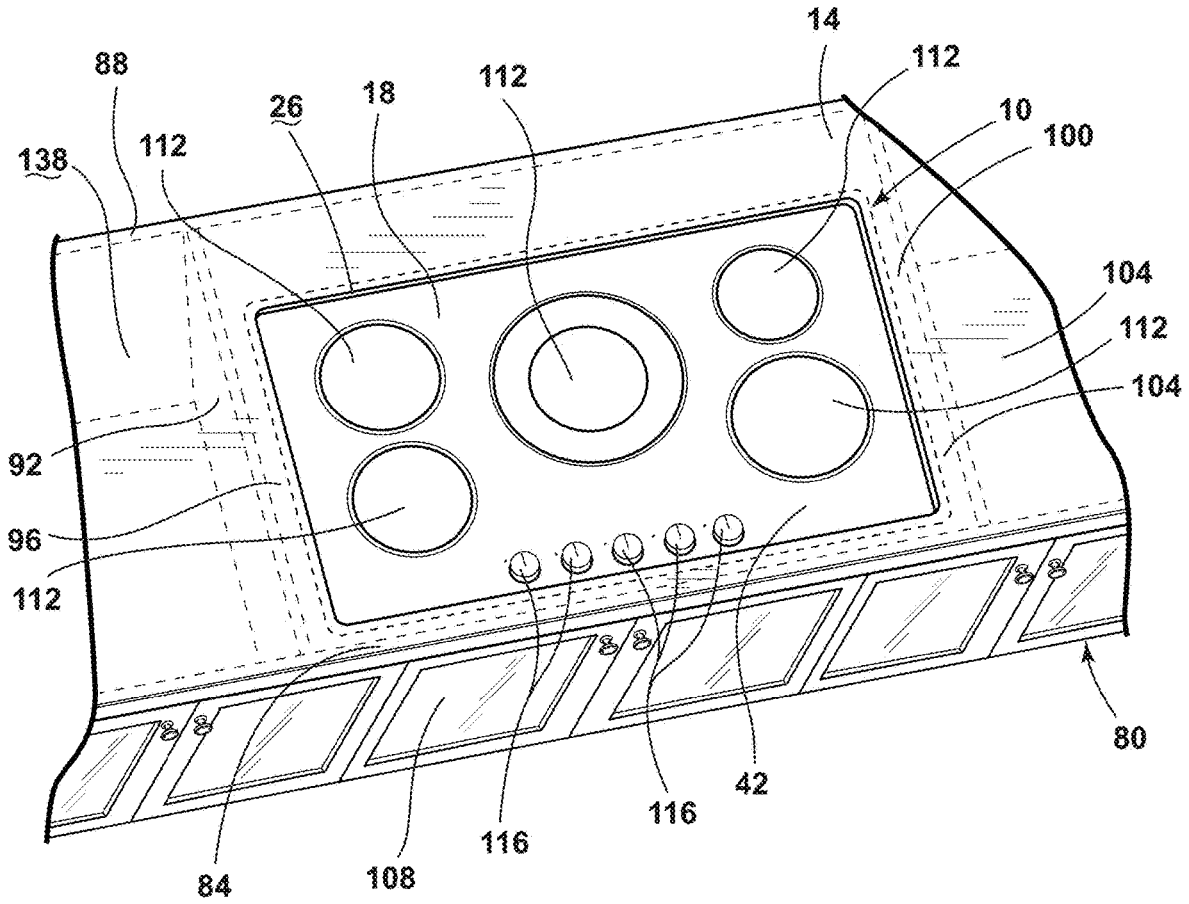
FIG. 1 is a top perspective view of a cooktop assembly mounted beneath a counter surface and aligned with an opening therein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to the drawings, wherein like reference numbers are used to designate similar features in various embodiments of the disclosure, descriptions related to a feature in one embodiment having like reference numbers in one or more other embodiments are applicable to the one or more other embodiments with like reference numbers.

Referring to FIGS. 1-4, a cooktop assembly 10 may include a countertop 14, a cooktop 18, and an attachment assembly 22. The countertop 14 may include a cutout portion 26 and a countertop contact area 30. The countertop contact area 30 may be disposed proximate a perimeter 34 of the cutout portion 26 and on a lower surface 38 of the countertop 14. The cooktop 18 may include a work portion 42 and a cooktop contact area 46. The cooktop contact area 46 may be disposed proximate a perimeter 50 of the work portion 42 and on an upper surface 54 of the cooktop 18. The attachment assembly 22 may include a first attachment member 58 and a second attachment member 62. The first attachment member 58 may be positionable proximate a back wall 66 of the cutout portion 26 of the countertop 14. The second attachment member 62 may be positionable proximate a front wall 70 of the cutout portion 26 of the countertop 14. The back wall 66 and the front wall 70 may be opposing walls. The first and second attachment members 58, 62 may be securable to the countertop 14 and the cooktop 18 to position the countertop contact area 30 adjacent the cooktop contact area 46 and to secure the cooktop 18 to the countertop 14.

Referring to FIG. 1, the cooktop 18 may be positioned beneath a cutout portion 26 of countertop 14 with the cutout portion 26 providing access to the work portion 42 of the cooktop 18. The countertop 14 may be mounted on a cabinet 80. The cabinet 80 may include a first cabinet wall 84 disposed at the front of the cabinet 80. The cabinet 80 may also include a second cabinet wall 88 disposed at the back of the cabinet 80. A third cabinet wall 92 may be disposed on a first side 96 of the cutout portion 26. A fourth cabinet wall 100 may be disposed on a second side 104 of the cutout portion 26. One or more doors 108 for accessing a cabinet interior may be disposed on the first cabinet wall 84. The cooktop 18 may include burners 112 that may be powered by electricity or gas. In one example, control knobs 116 may be disposed on the work portion 42. In various aspects, the cooktop 18 may be disposed beneath a planar surface or other support structure, such as a countertop. The cooktop 18 may be of an enclosed-top structure, wherein the work portion is defined by a solid substrate material, such as a sheet of glass or the like. In such an example, burners 112 may be radiant electric burners or induction burners. Further, the cooktop 18 may include a lower enclosure, such that the burners 112 are fully enclosed within the cooktop 18 in a similar manner to what is shown in the figures. Alternatively, the underside of the cooktop 18 can be open, such that the lower surfaces of the burners 112 and/or other internal features associated therewith are exposed. In various aspects, the cooktop 18 may include a griddle or other heated surface.

Figure 2:
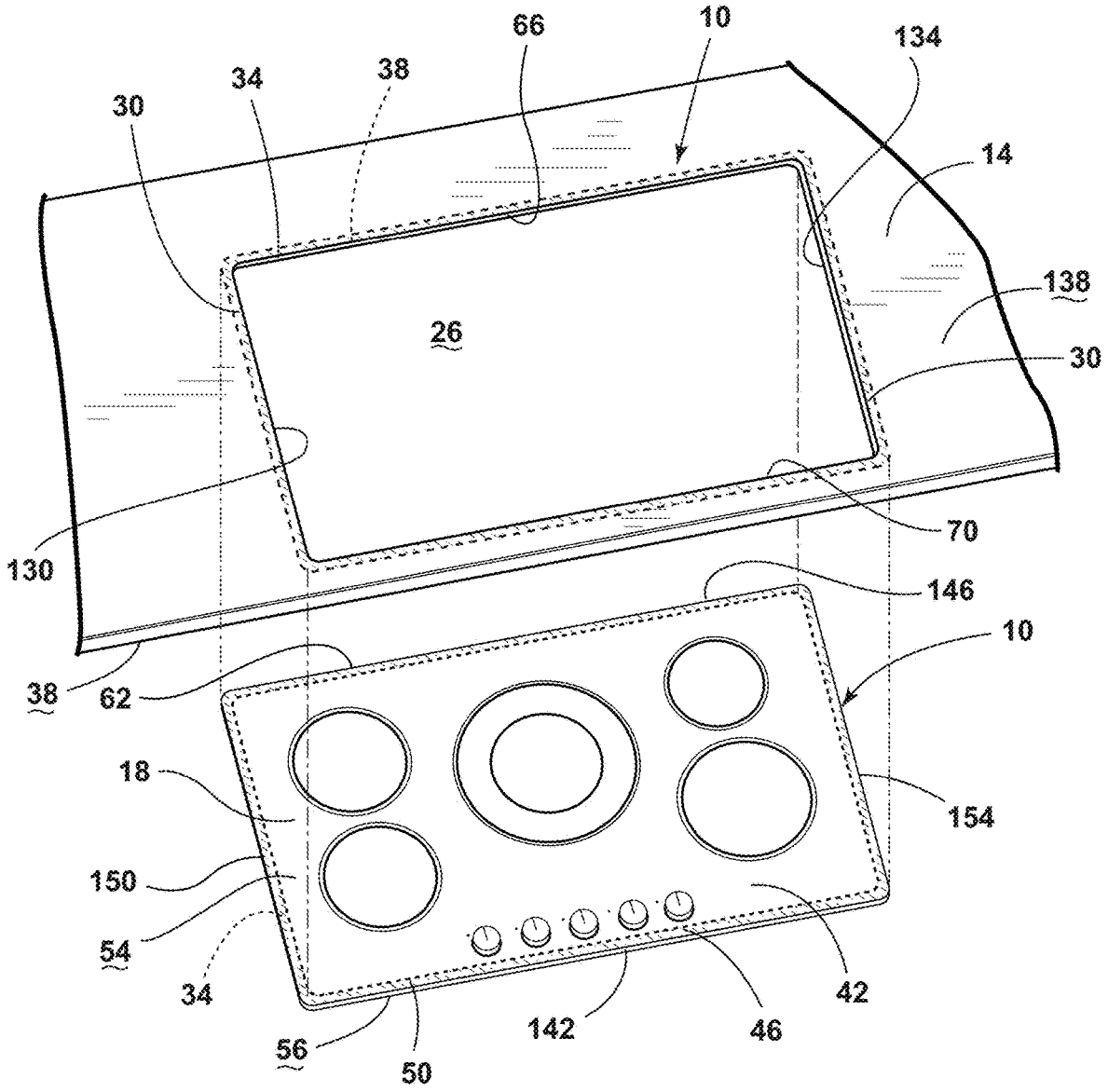
FIG. 2 is an exploded view of the cooktop assembly and counter surface of FIG. 1.

With reference now to FIG. 2, an exploded view of the cooktop 18 positioned beneath the countertop 14 is shown. In the depicted aspect, the cutout portion 26 of the countertop 14 is defined by a front wall 70, a back wall 66, a first side wall 130, and a second side wall 134, the first and second side walls 130, 134 being formed by the thickness of countertop 14 around the perimeter 34 of the cutout portion 26. In various aspects, the cutout portion 26 may be defined by fewer than four or more than four walls. For example, the cutout portion 26 may be defined by a first side wall 130 and a second side wall 134. In various aspects, the cutout portion 26 may be various shapes (for example, circular or oval). The countertop 14 includes an upper countertop surface 138 and a lower countertop surface 38. The countertop 14 includes a countertop contact area 30 that is disposed proximate a perimeter 34 of the cutout portion 26 and on the lower surface 38 of the countertop 14.

With continuing reference to FIG. 2, the cooktop 18 is defined by a front edge 142, a back edge 146, a first side edge 150, and a second side edge 154. The cooktop 18 includes an upper surface 54 and a lower surface 56. The cooktop 18 includes a work portion 42. As shown in FIG. 1, the work portion 42 may be the exposed portion when the cooktop 18 is mounted beneath the countertop 14. The cooktop contact area 46 is disposed proximate a perimeter 50 of the work portion 42 and on the upper surface 54 of the cooktop 18. When the upper surface 54 of the cooktop 18 is secured to the lower surface 38 of the countertop 14, the cooktop contact area 46 and the countertop contact area 30 are adjacent to one another. An interface portion 158 is formed where the cooktop contact area 46 and the countertop contact area 30 are positioned adjacent to each other including by direct mutual contact. In some implementations, when the upper surface 54 of the cooktop 18 is secured to the lower surface 38 of the countertop 14, the interface portion 158 may include an abutting fit between the cooktop contact area 46 and the countertop contact area 30. The abutting fit may be made substantially leak-proof, such that fluids, including cooking liquids, are substantially blocked between the cooktop contact area 46 and the countertop contact area 30. For example, the interface portion 158 may be sealed by an elastomeric element, caulk, or other sealant. In other examples, the interface portion 158 may include a gasket or other contact elements when the upper surface 54 of the cooktop 18 is secured to the lower surface 38 of the countertop 14 and the cooktop contact area 46 and the countertop contact area 30 are adjacent to one another.

For various reasons, it may be desirable to have cooktop 18 mounted below countertop 14 in a manner similar to that which is shown in FIG. 1. Accordingly, it may be desirable to mount the cooktop 18 to the countertop 14 securely to retain the cooktop 18 in place during cooking and to provide the ability to prevent liquids disposed on the cooktop 18 from seeping between the cooktop 18 and the countertop 14. In such instances, it may be desirable to have a mechanism for facilitating easy attachment and for detaching the cooktop 18 from the countertop 14 for servicing of the cooktop 18.

Figure 3:
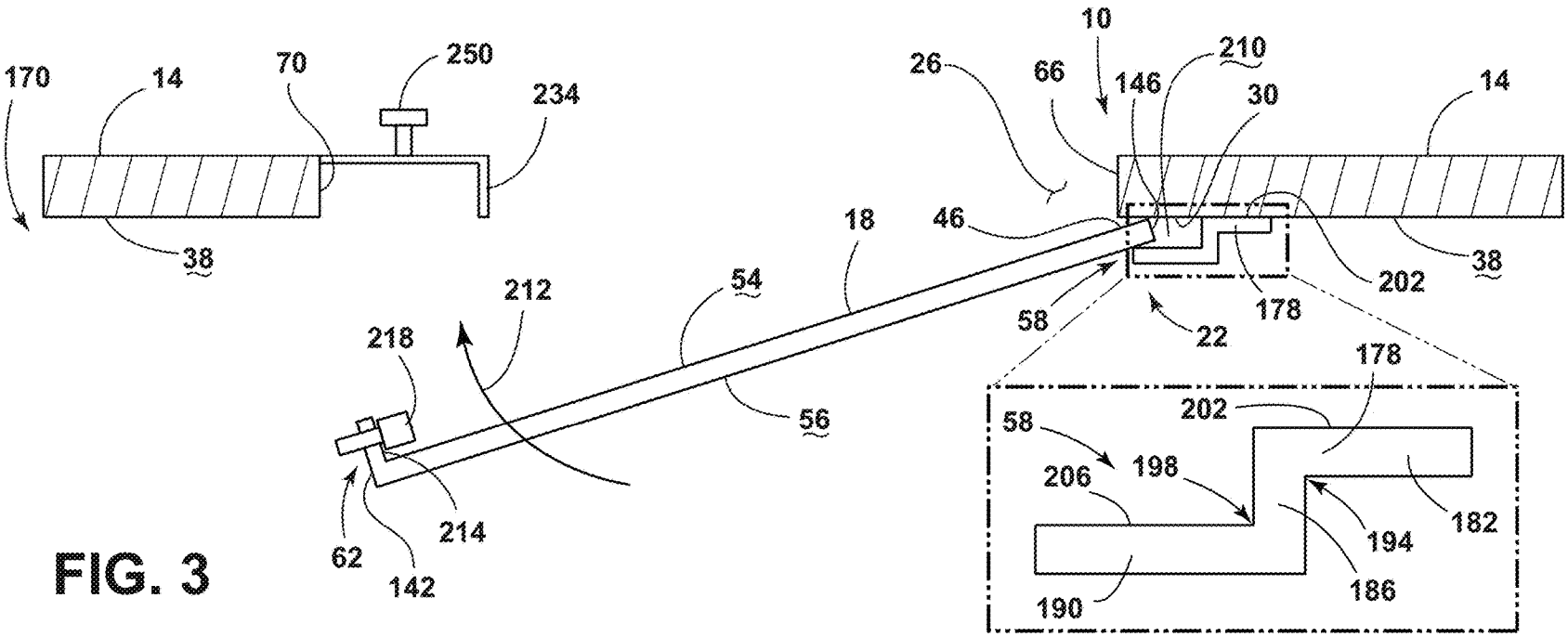
FIG. 3 is a cross-sectional view of a cooktop assembly usable in an undermount arrangement in an uninstalled position.
Figure 4:
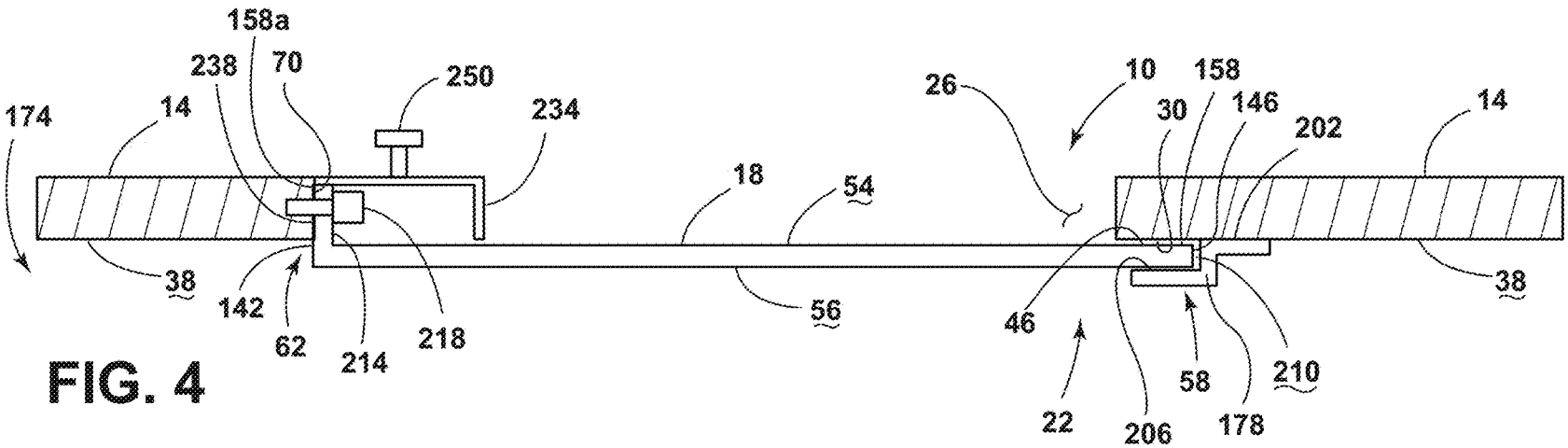
FIG. 4 is a cross-sectional view of the cooktop assembly of FIG. 3 in an installed position.

With reference to FIGS. 3 and 4, in one example, a mechanism for securing an undermount cooktop 18 within cutout portion 26 in countertop 14 is shown. In FIG. 3, cooktop 18 is shown in a first position 170, or an "uninstalled" position. In FIG. 4, cooktop 18 is shown in a second position 174, or an "installed" position. Referring to FIG. 3, a cross-sectional view of the cutout portion 26 is shown. The cooktop 18 is positionable to span the cutout portion 26 between the front wall 70 of the cutout portion 26 and the back wall 66 of the cutout portion 26 (FIG. 2). A bracket 178 may be secured beneath the countertop 14 near the back wall 66 of the countertop 14. The bracket 178 includes a step-like configuration that may include a first portion 182, a second portion 186, and a third portion 190. The first portion 182 of the bracket 178 may be substantially horizontally disposed below the countertop 14. A first bend angle 194 of approximately 90 degrees exists between the substantially horizontal first portion 182 disposed below the countertop 14 and the substantially vertical second portion 186 projecting downward from the first portion 182 and away from the countertop 14. A second bend angle 198 of approximately 90 degrees exists between the substantially vertically disposed second portion 186 and a substantially horizontally disposed third portion 190. The third portion 190 extends inward from the second portion 186 and toward the inside of the cutout portion 26.

The bracket 178 may include a first mounting area 202 that is engageable with the lower surface 38 of the countertop 14 and a second mounting area 206 that is engageable with the lower surface 56 of the cooktop 18. The first mounting area 202 may be disposed on a first portion 182 of the bracket 178. The second mounting area 206 may be disposed on a third portion 190 of the bracket 178. A back edge 146 of the cooktop 18 may be slid into a recess 210 defined by the lower surface 38 of the countertop 14, the second portion 186 of the bracket 178, and the third portion 190 of the bracket 178. As the back edge 146 of the cooktop 18 is slid into the recess 210, the front edge 142 of the cooktop 18 is swung into contact with the front wall 70 of the cutout portion 26 in a direction depicted by arrow 212.

Referring to FIG. 4, an upturned flange 214 may define or otherwise be assembled with the front edge 142 of the cooktop 18. In the second or installed position, the upturned flange 214 may be positioned adjacent to the front wall 70 of the cutout portion 26. An interference portion 158*a* may exist where the front edge 142 of the cooktop 18 disposed on the upturned flange 214 contacts the front wall 70 of the cutout portion 26. One or more fasteners 218, such as screws, bolts, or the like, may be inserted through the upturned flange 214 and into engagement with the front wall 70 of the cutout portion 26 to secure the upturned flange 214 to the countertop 14. The fasteners 218 may be inserted through holes in the upturned flange 214 and into recesses in the front wall 70. In various embodiments, fastener 218 and an additional fastener(s) (not shown) are disposed along the upturned flange 214 to secure the cooktop 18 to the front wall 70 of the cutout portion 26. The fasteners 218 may include set screws or other fasteners.

With continued reference to FIG. 4, a cover 234 may be positioned over the intersection 238 of the upturned flange 214 and the front wall 70 of the cutout portion 26 to conceal the upturned flange 214 and the fasteners 218. Various knobs 250 or other controls and/or displays of a cooktop 18 may be disposed on the cover 234. In various embodiments, the cover 234 may serve a cosmetic purpose. In various aspects, the knobs 250 may be disposed on one or more of the cooktop 18, the countertop 14, an elongated cover 234, or other area in communication with the cooktop 18, and the knobs 250 or other controls may mechanically or electrically couple with corresponding features of cooktop 18 to allow for knobs 250 to control the operation of burners 112 or the like.

With continued reference to FIG. 4, bracket 178 may be a single bracket that spans a width of the cutout portion 26 proximate the back wall 66 of the cutout portion 26 or a plurality of discrete spaced brackets 178 disposed along a width of the cutout portion 26 proximate the back wall 66 of the cutout portion 26. In various embodiments of the disclosure, the cooktop 18 may be placed in the cutout portion 26 in various orientations. For example, the bracket 178 may be positioned so that the bracket 178 attaches to the countertop 14 proximate the back wall 66 of the cutout portion 26. With further reference to the first embodiment, the upturned flange 214 may be positioned so that the upturned flange 214 attaches to the countertop 14 proximate the front wall 70 of the cutout portion 26.

Figure 5:
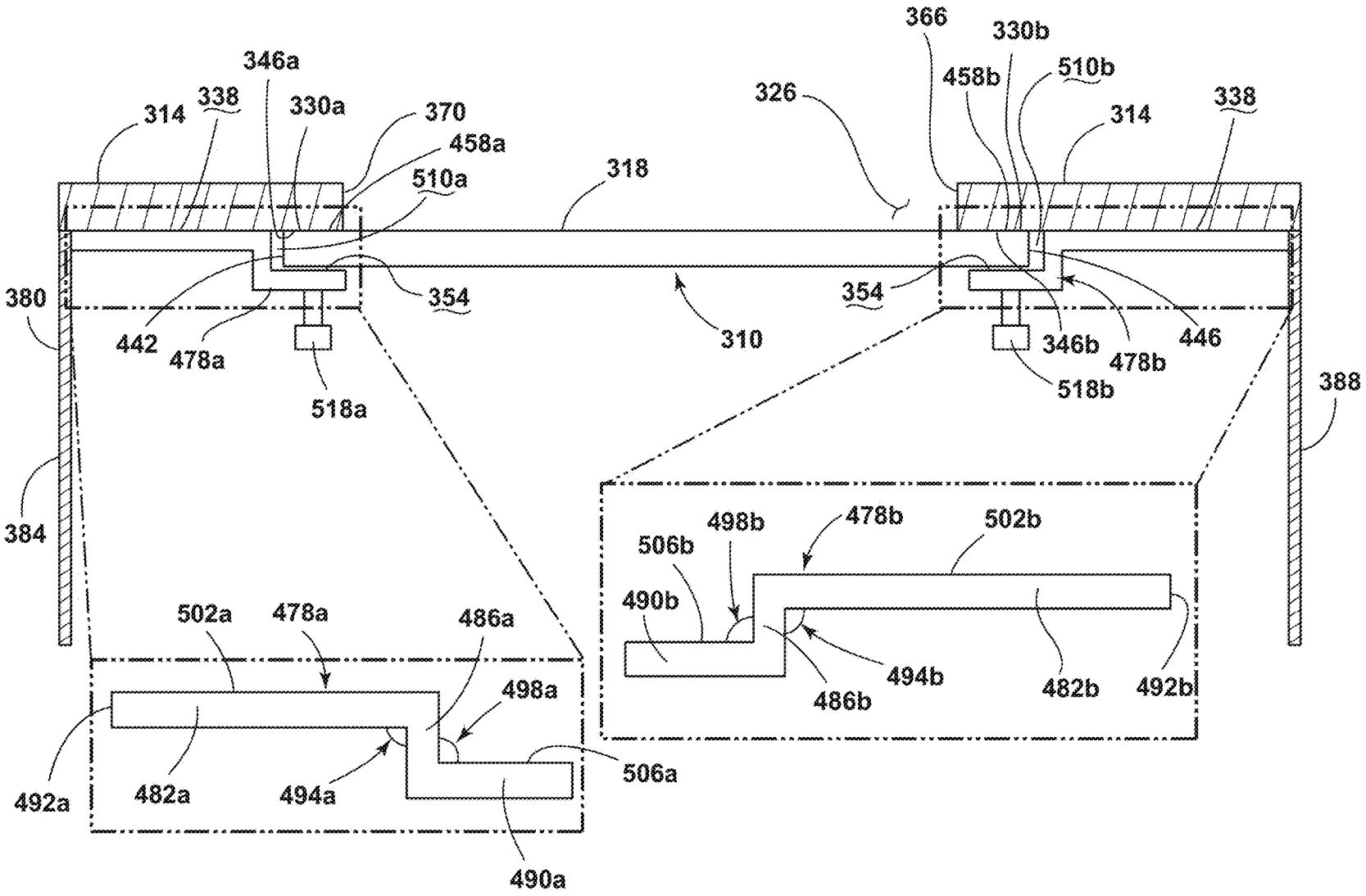
FIG. 5 is a cross-sectional view of a variation of the cooktop assembly of FIG. 1.

With reference to FIG. 5, a second example of a cooktop assembly 310 including an alternate attachment mechanism is shown. In the present example, a cooktop 318 is secured in the cutout portion 326 of countertop 314. First and second brackets 478*a*, 478*b* secure the cooktop 318 to the countertop 314. Each of the first and second brackets 478*a*, 478*b* may have a step-like configuration that includes a first portion 482*a*, 482*b*, a second portion 486*a*, 486*b*, and a third portion 490*a*, 490*b*. As stated with regard to the bracket 178 of the first embodiment (FIGS. 3 and 4), the first portions 482*a*, 482*b* of each of the first and second brackets 478*a*, 478*b* may be substantially horizontally disposed below the countertop 314. First bend angles 494*a*, 494*b* of approximately 90 degrees exist between the substantially horizontal first portions 482*a*, 482*b* disposed below the countertop 314 and the substantially vertical second portions 486*a*, 486*b* projecting downward from the first portions 482*a*, 482*b* and away from the countertop 314. Second bend angles 498*a*, 498*b* of approximately 90 degrees exist between the substantially vertically disposed second portions 486*a*, 486*b* and the substantially horizontally disposed third portions 490*a*, 490*b*. The third portions 490*a*, 490*b* extend inward from the respective second portions 486*a*, 486*b* and toward the cutout portion 326.

In various examples, with reference to the cooktop assembly 310 shown in FIG. 5, an engagement member may include the third portion 490*a* of the first bracket 478*a*, the third portion 490*b* of the second bracket 478*b*, or another part that similarly interacts with the cooktop 318. In various examples, with reference again to the cooktop assembly 310 shown in FIG. 5, an extension member may include the second portion 486*a* of the first bracket 478*a*, the second portion 486*b* of the second bracket 478*b*, or another part that similarly interacts with the cooktop 318.

In various examples, with reference again to the cooktop assembly 310 shown in FIG. 5, an extension member may include the first and second portions 482*a*, 486*a* of the first bracket 478*a*, the first and second portions 482*b*, 486*b* of the second bracket 478*b*, or another part that similarly interacts with the cooktop 318.

With continued reference to FIG. 5, each of the first and second brackets 478*a*, 478*b* may include first mounting areas 502*a*, 502*b* that are engageable with the lower surface 338 of the countertop 314. Each of the first and second brackets 478*a*, 478*b* may include second mounting areas 506*a*, 506*b* that are engageable with the lower surface 354 of the cooktop 318. In the illustrated example, the first mounting areas 502*a*, 502*b* are disposed on first portions 482*a*, 482*b* of each of the first and second brackets 478*a*, 478*b*. The second mounting areas 506*a*, 506*b* are disposed on third portions 490*a*, 490*b* of each of the first and second brackets 478*a*, 478*b*. Each of the first and second brackets 478*a*, 478*b* includes abutting portions 492*a*, 492*b* disposed on the first portions 482*a*, 482*b* of each of the first and second brackets 478*a*, 478*b*. The abutting portion 492*a* of the first bracket 478*a* may contact a first cabinet wall 384 disposed at the front of the cabinet 380. The abutting portion 492*b* of the second bracket 478*b* may contact the second cabinet wall 388 disposed at the back of the cabinet 380 (FIG. 1). When the first and second brackets 478*a*, 478*b* are positioned below the lower surface 338 of the countertop 314, first and second recesses 510*a*, 510*b* are defined by the first and second brackets 478*a*, 478*b* and the countertop 314. The first recess 510*a* is located proximate the front wall 370 of the cutout portion 326. The second recess 510*b* is located proximate the back wall 366 of the cutout portion 326. The first recess 510*a* is defined by the lower surface 338 of the countertop 314, the second portion 486*a* of the first bracket 478*a*, and the third portion 490*a* of the first bracket 478*a*. The second recess 510*b* is defined by the lower surface 338 of the countertop 314, the second portion 486*b* of the second bracket 478*b*, and the third portion 490*b* of the second bracket 478*b*.

Referring again to FIG. 5, a first lifting element 518*a* is engageable with the third portion 490*a* of the first bracket 478*a* and the cooktop 318. A second lifting element 518*b* is engageable with the third portion 490*b* of the second bracket 478*b* and the cooktop 318. The first and second lifting elements 518*a*, 518*b* engage with the first and second brackets 478*a*, 478*b* and exert an upward pressure onto the cooktop 318 to force the cooktop 318 into a position adjacent the countertop 314 and may be various bolts, thrust screws, thumb screws, or other threaded fasteners. In this arrangement, the first lifting element 518*a* may extend through a hole (not shown) in the third portion 490*a* of the first bracket 478*a*. The second lifting element 518*b* may extend through a hole (not shown) in the third portion 490*b* of the second bracket 478*b*. In this arrangement, the first and second lifting elements 518*a*, 518*b* are adjustable to tighten into the cooktop 318 and to urge the cooktop 318 upward so that it is adjacent to the countertop 314 at cooktop contact areas 346*a*, 346*b* and the countertop contact areas 330*a*, 330*b* and allows the first and second brackets 478*a*, 478*b* and the respective first and second recesses 510*a*, 510*b* to be oversized relative to the cooktop 318 for convenience of assembly. Interface portions 458*a*, 458*b* are defined by the adjacent cooktop contact areas 346*a*, 346*b* and the countertop contact areas 330*a*, 330*b*. In various embodiments, the interface portions 458*a*, 458*b* may include an abutting fit between the cooktop contact areas 346*a*, 346*b* and the countertop contact areas 330*a*, 330*b*. As previously explained with reference to the first embodiment (FIGS. 3 and 4), the abutting fit may substantially block fluids such as cooking liquids from seeping between the cooktop contact area 346*a*, 346*b* and the countertop contact area 330*a*, 330*b*.

With continuing reference to FIG. 5, in various aspects, more than one bracket 478*a*, 478*b* with lifting elements 518*a*, 518*b* may be disposed along the front edge 442 of the cooktop 318 and the back edge 446 of the cooktop 318. In one aspect, a first set of two brackets and two lifting elements may be disposed along the front edge 442 of the cooktop 318, and a second set of two brackets and two lifting elements may be disposed along the back edge 446 of the cooktop 318. In another aspect, one or more of brackets 478*a* and 478*b* could have multiple lifting elements 518*a*, 518*b* disposed along the brackets 478*a* and 478*b*. In another aspect, one or more of brackets 478*a* and 478*b* could comprise a plurality of separate brackets 478*a* and 478*b* and a corresponding plurality of separate lifting elements 518*a*, 518*b* disposed along one or more of the front edge 442 and the back edge 446 of the cooktop 318. In yet another aspect, one or more brackets 478*a* and 478*b* could comprise a plurality of separate brackets 478*a* and 478*b* and a corresponding plurality of separate lifting elements 518*a*, 518*b* disposed along first side edge 150, as shown in FIG. 2 with reference to cooktop assembly 10, and second side edge 154, as shown in FIG. 2 with reference to cooktop assembly 10, or along front edge 442, back edge 446, and first side edge 150, and second side edge 154, as shown in FIG. 2 with reference to cooktop assembly 10.

Figure 6:
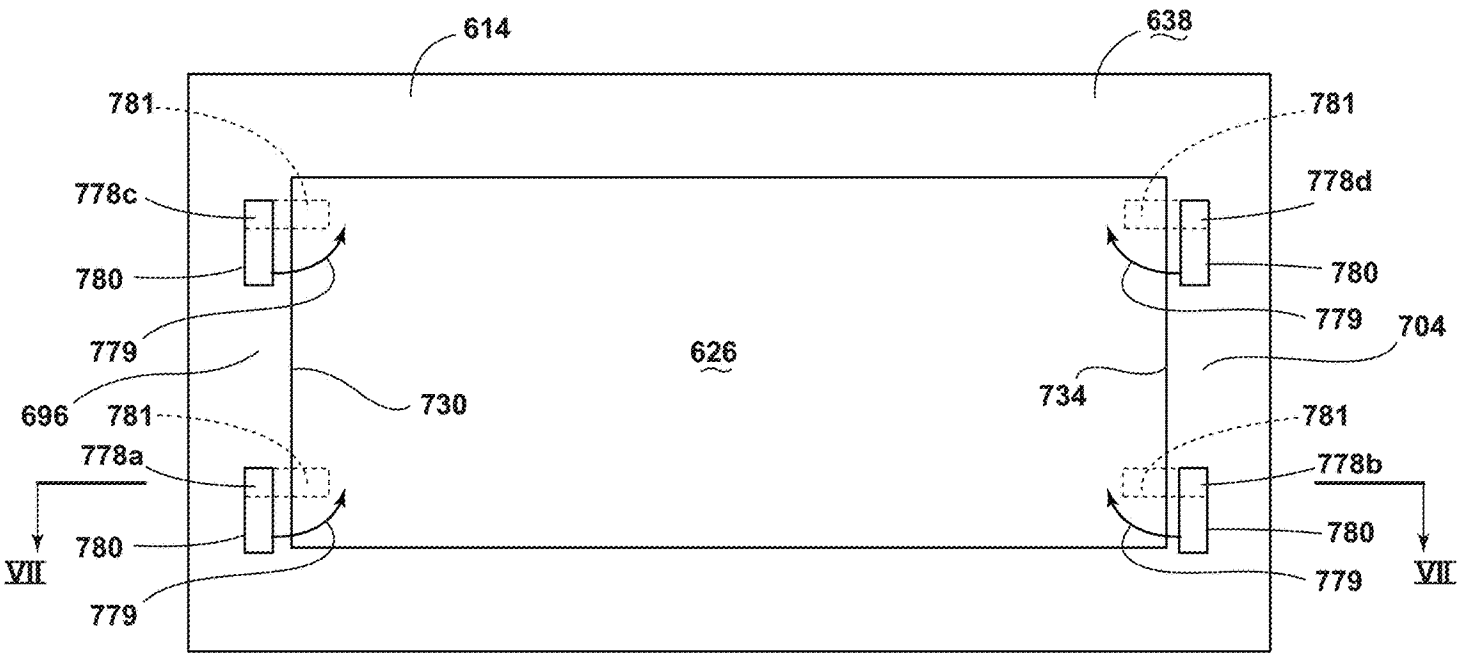
FIG. 6 is a bottom elevation view of the lower surface of a support structure and an attachment assembly of a further variation of the cooktop assembly of FIG. 1.
Figure 7:
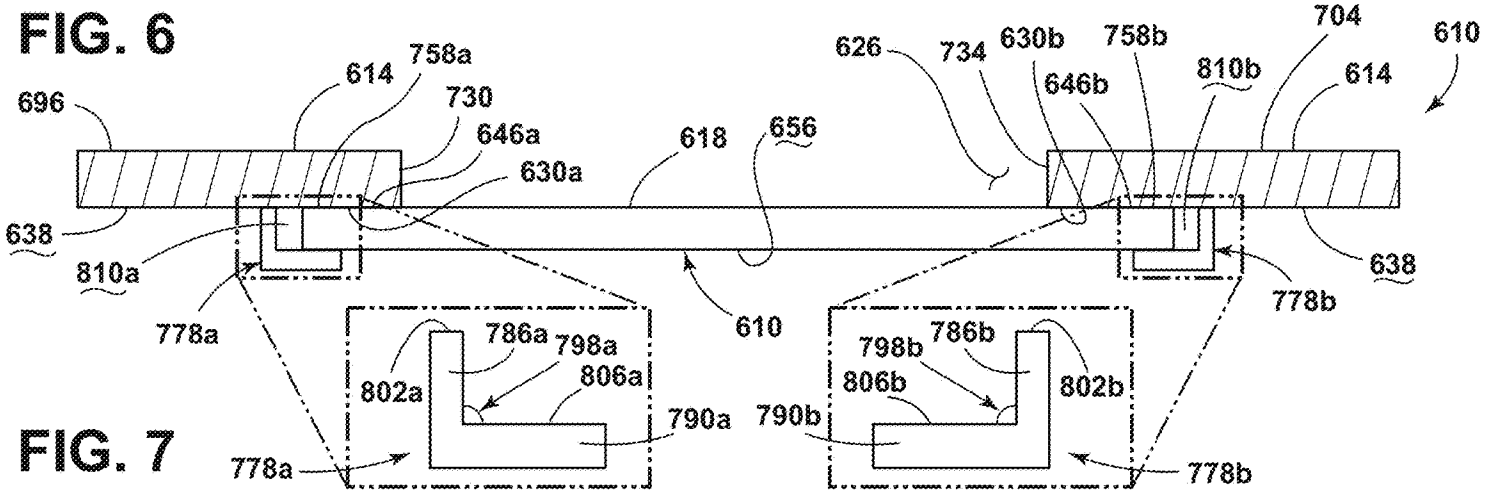
FIG. 7 is a cross-sectional view of the cooktop assembly variation of FIG. 6 taken along line VII-VII of FIG. 6.

Referring to FIGS. 6-7, a third cooktop assembly example is designated as cooktop 610. FIG. 6 is a bottom elevational view of the lower surface 638 of the countertop 614 with cutout portion 626. First bracket 778*a* and second bracket 778*b* are disposed at the first side 696 and the second side 704, respectively, of the cutout portion 626. Additionally, third and fourth brackets 778*c*, 778*d* are disposed proximate the first side wall 730 and the second side wall 734, respectively, of the cutout portion 626. The first, second, third, and fourth brackets 778*a*, 778*b*, 778*c*, 778*d* turn from an unfastened position 780 to a fastened position 781 in directions 779. The first, second, third, and fourth brackets 778*a*, 778*b*, 778*c*, 778*d* may be rotated between unfastened 780 and fastened 781 positions to secure the cooktop 618 to the countertop 614.

FIG. 7 shows cooktop 618 disposed between a first bracket 778*a* and a second bracket 778*b*. Each of the first and the second brackets 778*a*, 778*b* have an L-shaped configuration. Each of the first bracket 778*a* and the second bracket 778*b*, as illustrated, includes first portions 786*a*, 786*b* and second portions 790*a*, 790*b*. The first portions 786*a*, 786*b* extend substantially vertically downward from the countertop lower surface 638. Bend angles 798*a*, 798*b* of approximately 90 degrees are formed between the first portions 786*a*, 786*b* and the second portions 790*a*, 790*b* of the first and second brackets 778*a*, 778*b*. The second portions 790*a*, 790*b* extend inward towards the cutout portion 626 in a fastened position 781. The first bracket 778*a* and the second bracket 778*b* each include first mounting areas 802*a*, 802*b* that are engageable with the lower surface 638 of the countertop 614 and second mounting areas 806*a*, 806*b* that are engageable with the lower surface 656 of the cooktop 618. The first mounting areas 802*a*, 802*b* are disposed on the first portions 786*a*, 786*b* of each of the first and second brackets 778*a*, 778*b*. The second mounting areas 806*a*, 806*b* are disposed on the second portions 790*a*, 790*b* of each of the first and second brackets 778*a*, 778*b*.

In various examples, with reference to the cooktop assembly 610 shown in FIG. 7, an engagement member may include a second portion 790*a* of a first bracket 778*a* or a second portion 790*b* of a second bracket 778*b*. In various examples, with reference to the cooktop assembly 610 shown in FIG. 7, an extension member may include a first portion 786*a* of a first bracket 778*a* or a first portion 786*b* of a second bracket 778*b*.

With further reference to FIG. 7, a first recess 810*a* is located proximate the first side wall 730 of the cutout portion 626. A second recess 810*b* is located proximate the second side wall 734 of the cutout portion 626. The first recess 810*a* is defined by the lower surface 638 of the countertop 614, the first portion 786*a* of the first bracket 778*a*, and the second portion 790*a* of the first bracket 778*a*. The second recess 810*b* is defined by the lower surface 638 of the countertop 614, the first portion 786*b* of the second bracket 778*b*, and the second portion 790*b* of the second bracket 778*b*. In the fastened position 781, interface portions 758*a*, 758*b* are between the cooktop contact areas 646*a*, 646*b* and the countertop contact areas 630*a*, 630*b*. The interface portions 758*a*, 758*b* may include an abutting fit between the cooktop contact areas 646*a*, 646*b* and the countertop contact areas 630*a*, 630*b*.

The cross-sectional view of the first and second brackets 778*a* and 778*b* in FIG. 7 shows the second portions 790*a* and 790*b* of the brackets 778*a* and 778*b* in the fastened position 781 below the cooktop 618 by which brackets 778*a*, 778*b* secure the cooktop 618 to the countertop 614. The third and fourth brackets 778*c* and 778*d* may have the same configuration as the first and second brackets 778*a* and 778*b*. The first, second, third, and fourth brackets 778*a*, 778*b*, 778*c*,

778*d* may be initially disposed in unfastened positions 780 such that second portions 790*a*, 790*b* of the first and second brackets 778*a* and 778*b* and the second portions (not shown) of the third and fourth brackets 778*c* and 778*d* extend substantially parallel to first and second walls 730, 734 of the cutout portion 626. When the cooktop 618 is positioned below the cutout portion 626, the first, second, third, and fourth brackets 778*a*, 778*b*, 778*c*, 778*d* may be rotated to their fastened positions 781 such that the second portions 790*a* and 790*b* of the first and second brackets 778*a* and 778*b* and the second portions (not shown) of the third and fourth brackets 778*c* and 778*d* extend underneath the cooktop 618. The second portions 790*a* and 790*b* of the first and second brackets 778*a* and 778*b* and the second portions (not shown) of the third and fourth brackets 778*c* and 778*d* may be transverse to the first and second walls 730, 734 of the cutout portion 626 in the fastened position 781.

In the example of FIGS. 6 and 7, four brackets 778*a*, 778*b*, 778*c*, and 778*d* are shown. In various aspects of the disclosure, however, the cooktop assembly 610 may have more than four brackets 778*a*, 778*b*, 778*c*, and 778*d* or fewer than four brackets 778*a*, 778*b*, 778*c*, and 778*d* depending on characteristics of the cooktop assembly 610 (for example, size or weight of the cooktop 618) and of the brackets 778*a*, 778*b*, 778*c*, 778*d*.

With continued reference to FIGS. 6 and 7, the cooktop 618 may be placed in the cutout portion 626 in various orientations. The brackets 778*a*, 778*b* may be positioned so that they attach to the countertop 614 proximate the first side wall 730 and the second side wall 734 of the cutout portion 626.

Figure 8:
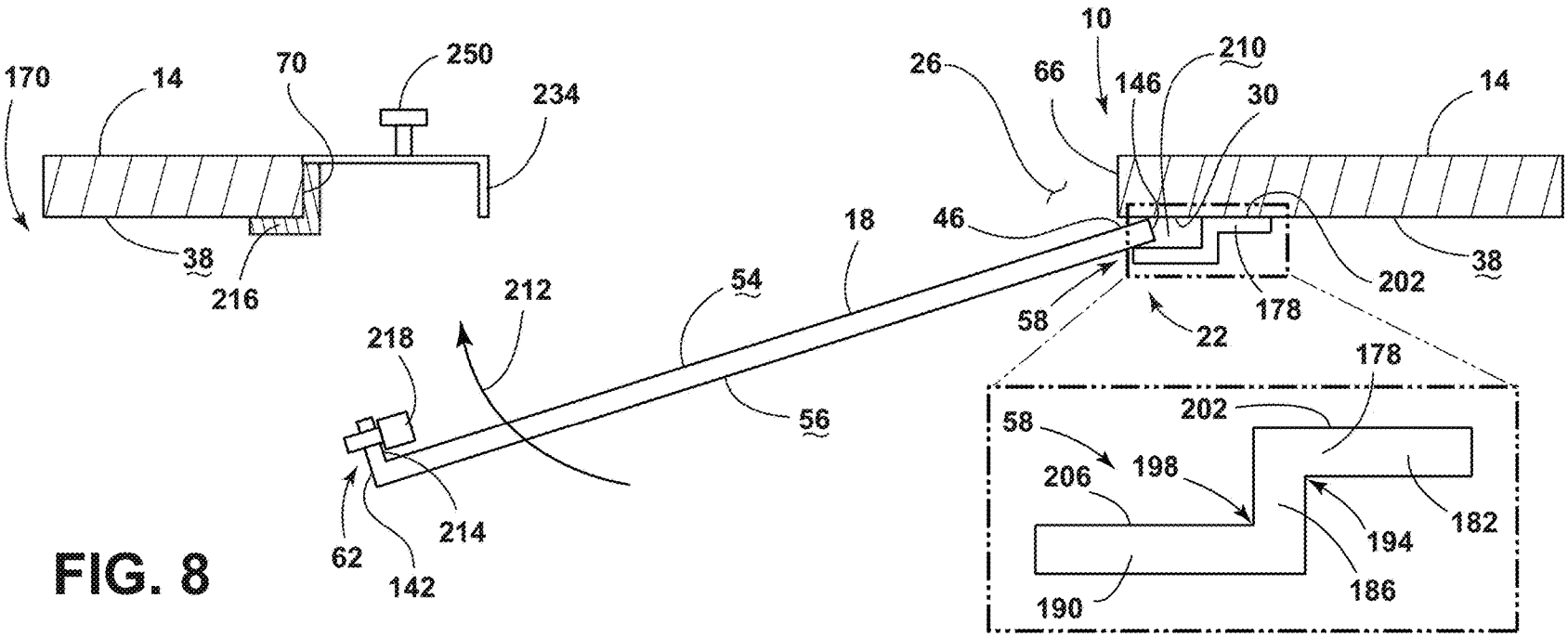
FIG. 8 is a variation of the cooktop assembly of FIG. 3 shown in an uninstalled position.
Figure 9:
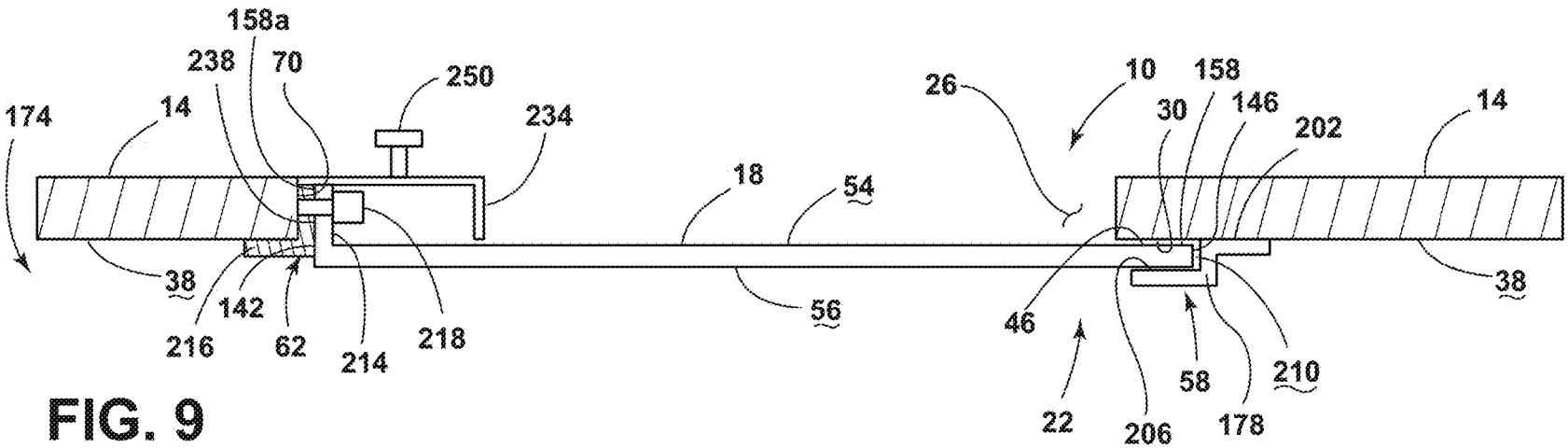
FIG. 9 is the cooktop assembly of FIG. 8 shown in an installed position.

FIGS. 8 and 9 show a variant of the cooktop assembly 10 shown in FIGS. 3 and 4. FIGS. 8 and 9 show a bracket 216 that may be glued or otherwise attached to the countertop 14. The bracket 216 may receive a fastener 218 that may secure the upturned flange 214 to the bracket 216. The bracket 216 may be an elongated bracket with one or more fasteners 218 that spans a width of the cutout portion 26 proximate a front wall 70 of the cutout portion 26. Alternatively, the bracket 216 may comprise a plurality of brackets disposed proximate the front wall 70 of the cutout portion 26. Each of the plurality of brackets may receive one or more fasteners 218. As such, the bracket 216 receives the fastener 218, and the need for drilling or otherwise forming holes in the countertop 14 may be minimized or avoided.

In various aspects of the disclosure, the attachment assembly allows detachment of the cooktop from the countertop.

A variety of advantages may be derived from the present disclosure. A cooktop may be conveniently mounted to a countertop. A cooktop may be integrated with a countertop.

In various embodiments, the invention may be characterized in various clauses and various combinations thereof, including the following paragraphs:

An undermount cooktop assembly including first and second lifting elements extending through each of the first and second engagement members and toward a lower surface of the cooktop when the cooktop is positioned below the countertop.

An undermount cooktop assembly wherein the first and second lifting elements are vertically adjustable to move the cooktop between a first position and a second position relative to the countertop.

An undermount cooktop assembly wherein the first position is defined by a first distance between the cooktop and the countertop and wherein the second position is defined by a second distance between the cooktop and the countertop.

An undermount cooktop assembly wherein at least one of the first and second brackets include a step-like configuration.

An undermount cooktop assembly wherein the step-like configuration includes an engagement member defined by a third portion of the at least one of the first and second brackets.

An undermount cooktop assembly wherein the step-like configuration includes an extension member defined by a second portion of at least one of the first and second brackets.

An undermount cooktop assembly wherein the extension member is further defined by a first portion of the at least one of the first and second brackets.

An undermount cooktop assembly wherein at least one of the first and second brackets include a L-shaped configuration.

An undermount cooktop assembly wherein the L-shaped configuration includes an engagement member defined by a second portion of the at least one of the first and second brackets.

An undermount cooktop assembly wherein the L-shaped configuration includes an extension member defined by a first portion of at least one of the first and second brackets.

An undermount cooktop assembly wherein the undermount cooktop is positionable beneath a cutout portion of a countertop and wherein the first and second engagement members are movable between first and second positions to secure the cooktop to the countertop.

An undermount cooktop assembly wherein the first position is an unfastened position and wherein the second position is a fastened position.

An undermount cooktop assembly, wherein in the unfastened position, the first and second engagement members are positionable below the countertop, and wherein, in the fastened position, the first and second engagement members are disposed below the cooktop.

An attachment assembly for a cooktop wherein first and second lifting elements are positionable proximate the second mounting areas of the respective first and second brackets.

A countertop including an attachment assembly for a cooktop, wherein the countertop comprises a lower surface including a countertop contact area disposed around a cutout portion of the countertop, wherein the cooktop comprises a cooktop contact area disposed around a perimeter of the cooktop, and wherein the cooktop contact area is arrangeable below the countertop contact area thereby positioning a work area of the cooktop within the cutout portion.

A countertop including an attachment assembly for a cooktop wherein the first bracket and the second bracket are each movable from an unfastened position to a fastened position to secure the cooktop contact area to the countertop contact area.

A countertop including an attachment assembly for a cooktop further comprising first and second adjustable lifting elements extending through the respective first and second brackets and configured to move the cooktop between a first distance from the countertop and a second distance from the countertop.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments are illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures without departing from the concepts of the present device, and further, it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A cooktop assembly, comprising:

a countertop defining a cutout portion and a countertop contact area disposed proximate a perimeter of the cutout portion on a lower surface of the countertop;

a cooktop defining a work portion and a cooktop contact area disposed proximate a perimeter of the work portion on an upper surface of the cooktop;

an attachment assembly including:

a first attachment member positionable on a first side of the cutout portion of the countertop; and a second attachment member positionable on a second side of the cutout portion of the countertop; and wherein the first and second sides are opposing sides, and the first and second attachment members are securable to the countertop and the cooktop to engage the countertop contact area disposed on the lower surface of the countertop with the cooktop contact area disposed on the upper surface of the cooktop, thereby securing the cooktop to the countertop.

2. The cooktop assembly of claim 1, wherein at least one of the first attachment member and the second attachment member include a first mounting area engageable with the countertop and a second mounting area engageable with the cooktop.

3. An undermount cooktop assembly, comprising:

a cooktop including a work portion, an underside opposite the work portion, and a cooktop contact area disposed around a perimeter of the cooktop;

first and second brackets respectively defining a first engagement member and a second engagement member operably supporting the cooktop along the underside thereof and disposed on opposing sides of the work portion of the cooktop, each of the first and second brackets further defining respective extension members extending from the engagement members, and to respective positions spaced away therefrom in a direction towards the work portion, wherein the respective extension members are engageable with a lower surface of a countertop, the lower surface of the countertop includes a countertop contact area disposed around a cutout portion of the countertop, and the cooktop contact area is arrangeable below the countertop contact area thereby positioning a work area of the cooktop within the cutout portion of the countertop.

4. The undermount cooktop assembly of claim 3, further comprising:

first and second lifting elements extending through each of the first and second engagement members and toward a lower surface of the cooktop when the cooktop is positioned below the countertop.

5. The undermount cooktop assembly of claim 4, wherein:

the first and second lifting elements are vertically adjustable to move the cooktop between a first position and a second position relative to the countertop.

6. The undermount cooktop assembly of claim 5, wherein:

the first position is defined by a first distance between the cooktop and the countertop, and wherein the second position is defined by a second distance between the cooktop and the countertop.

7. The undermount cooktop assembly of claim 3, wherein at least one of the first and second brackets include a step-like configuration.

8. The undermount cooktop assembly of claim 7, wherein the at least one of the first and second brackets includes a first portion, a second portion, and a third portion defining the step-like configuration, an engagement member being further defined by the third portion of the at least one of the first and second brackets.

9. The undermount cooktop assembly of claim 8, wherein the second portion of at least one of the first and second brackets defines an extension member of the step-like configuration.

10. The undermount cooktop assembly of claim 9, wherein the extension member is further defined by the first portion of the at least one of the first and second brackets.

11. The undermount cooktop assembly of claim 3, wherein:

at least one of the first and second brackets include a L-shaped configuration.

12. The undermount cooktop assembly of claim 11, wherein:

at least one of the first and second brackets include a first portion and a second portion; and wherein the L-shaped configuration includes an engagement member defined by the second portion of the at least one of the first and second brackets.

13. The undermount cooktop assembly of claim 12, wherein:

the L-shaped configuration includes an extension member defined by the first portion of at least one of the first and second brackets.

14. The undermount cooktop assembly of claim 12, wherein:

the first position is an unfastened position and wherein the second position is a fastened position.

15. The undermount cooktop assembly of claim 13, wherein:

in the unfastened, position the first and second engagement members are positionable below the countertop, and wherein, in the fastened position, the first and second engagement members are disposed below the cooktop.

16. The undermount cooktop assembly of claim 3, wherein:

the first and second engagement members are movable between first and second positions to secure the cooktop to the countertop.

17. A countertop including an attachment assembly for a cooktop, comprising:

a cooktop;

first and second brackets disposed proximate the cooktop and coupled to the cooktop and each including:

a first mounting area; and a second mounting area;

wherein the second mounting area of each of the first and second brackets is positionable to support a lower surface of the cooktop;

wherein the first mounting area of each of the first and second brackets is engageable with a countertop; and wherein the countertop comprises a lower surface including a countertop contact area disposed around a cutout portion of the countertop; and wherein the cooktop comprises a cooktop contact area disposed around a perimeter of the cooktop, and wherein the cooktop contact area is arrangeable below the countertop contact area thereby positioning a work area of the cooktop within the cutout portion.

18. The countertop including the attachment assembly for a cooktop of claim 17, further comprising:

first and second lifting elements positionable proximate the second mounting areas of the respective first and second brackets.

19. The countertop including the attachment assembly for a cooktop of claim 17, wherein:

the first bracket and the second bracket are each moveable from an unfastened position to a fastened position to secure the cooktop contact area to the countertop contact area.

20. The countertop including the attachment assembly for a cooktop of claim 17, further comprising:

first and second adjustable lifting elements extending through the respective first and second brackets and configured to move the cooktop between a first distance from the countertop and a second distance from the countertop.

* * * * *